US011462343B2

(12) United States Patent
Abe et al.

(10) Patent No.: US 11,462,343 B2
(45) Date of Patent: Oct. 4, 2022

(54) RESISTOR MANUFACTURING METHOD AND RESISTOR

(71) Applicant: KOA CORPORATION, Nagano (JP)

(72) Inventors: Yuichi Abe, Nagano (JP); Seiji Karasawa, Nagano (JP); Michio Kubota, Nagano (JP); Yoji Gomi, Nagano (JP); Koichi Minowa, Nagano (JP)

(73) Assignee: KOA CORPORATION, Nagano (JP)

( * ) Notice: Subject to any disclaimer, the term of this patent is extended or adjusted under 35 U.S.C. 154(b) by 260 days.

(21) Appl. No.: 16/771,393

(22) PCT Filed: Dec. 11, 2018

(86) PCT No.: PCT/JP2018/045456
§ 371 (c)(1),
(2) Date: Jun. 10, 2020

(87) PCT Pub. No.: WO2019/117127
PCT Pub. Date: Jun. 20, 2019

(65) Prior Publication Data

US 2020/0395150 A1 Dec. 17, 2020

(30) Foreign Application Priority Data

Dec. 12, 2017 (JP) ..... JP2017-237820

(51) Int. Cl.
*H01C 1/14* (2006.01)
*H01C 1/02* (2006.01)
*H01C 17/02* (2006.01)

(52) U.S. Cl.
CPC ..... *H01C 1/14* (2013.01); *H01C 1/02* (2013.01); *H01C 17/02* (2013.01)

(58) Field of Classification Search
CPC ..... H01C 1/14; H01C 1/02; H01C 17/02
See application file for complete search history.

(56) References Cited

U.S. PATENT DOCUMENTS 4,933,811 A * 6/1990 Dorlanne ..... H01G 2/065 361/773
5,563,572 A * 10/1996 Hetzler ..... H01C 1/142 338/307

(Continued)

FOREIGN PATENT DOCUMENTS

JP H11-162721 A 6/1999
JP 2004-128000 A 4/2004

(Continued)

OTHER PUBLICATIONS

International Search Report, dated Mar. 5, 2019 by the Japan Patent Office (JPO), in International Application No. PCT/JP2018/045456.

(Continued)

*Primary Examiner* — Kyung S Lee
(74) *Attorney, Agent, or Firm* — Greenblum & Bernstein, P.L.C.

(57) ABSTRACT

An object is to provide a resistor manufacturing method and a resistor capable of suppressing variation in the thickness of a thermally conductive layer intervening between a resistive body and electrode plates. The method of manufacturing the resistor according to the present invention includes a step of forming an uncured first thermally conductive layer on a surface of a resistive body, a step of curing the first thermally conductive layer, a step of laminating an uncured second thermally conductive layer on a surface of the first thermally conductive layer, and a step of bending electrode plates respectively disposed at both sides of the resistive body, curing the second thermally conductive layer, and performing adhesion between the resistive body and the electrode plates via the first thermally conductive layer and the second thermally conductive layer.

4 Claims, 7 Drawing Sheets

(56) References Cited

U.S. PATENT DOCUMENTS

| | | | | |
|---|---|---|---|---|
| 5,802,709 | A * | 9/1998 | Hogge | B32B 37/153 156/324 |
| 6,316,726 | B1 * | 11/2001 | Hidaka | H01G 4/228 257/696 |
| 7,190,252 | B2 * | 3/2007 | Smith | H01C 1/144 338/226 |
| 8,912,876 | B2 * | 12/2014 | Gomi | H01C 7/102 338/21 |
| 9,728,306 | B2 * | 8/2017 | Lu | H01C 1/028 |
| 11,011,290 | B2 * | 5/2021 | Abe | H01C 1/148 |
| 2006/0197648 | A1 * | 9/2006 | Smith | H01C 1/144 338/309 |
| 2009/0224865 | A1 | 9/2009 | Tanaka et al. | |

FOREIGN PATENT DOCUMENTS

| | | | |
|---|---|---|---|
| JP | 2008-532280 | A | 8/2008 |
| JP | 4806421 | B2 | 8/2011 |
| JP | 2015-008316 | A | 1/2015 |
| KR | 2017-0074367 | A | 6/2017 |

OTHER PUBLICATIONS

Partial Supplementary European Search Report, dated Aug. 2, 2021, by the European Patent Office (EPO) in European Patent Application No. 18887518.1.

* cited by examiner

RESISTOR MANUFACTURING METHOD AND RESISTOR

TECHNICAL FIELD

The present invention relates to a resistor manufacturing method, and a resistor.

BACKGROUND ART

Patent Literature 1 discloses an invention that relates to a resistor, and a method of manufacturing the resistor. The resistor disclosed in Patent Literature 1 includes a resistive body, electrode plates which are positioned at both sides of the resistive body, respectively, and bent toward the lower surface side of the resistive body, and an electrically non-conductive filler interposed between the resistive body and the electrode plates.

The filler serves to adhere the resistive body to the electrode plates. In the resistor as disclosed in Patent Literature 1, heat propagates from the resistive body to the electrode plates via the filler to secure a heat dissipation property.

CITATION LIST

Patent Literature

Patent Literature 1: Japanese Patent No. 4806421

SUMMARY OF INVENTION

Technical Problem

In Patent Literature 1, the filler in the uncured and unsolidified state is disposed on the surface of the resistive body, and the electrode plates are bent to be in contact with the filler. Thereafter, the filler is cured and solidified.

In Patent Literature 1, as the filler in contact with the bent electrode plates is uncured, the filler exhibits high fluidity. The high fluidity is likely to cause the thickness variation of the filler between the resistive body and the electrode plates. Accordingly, the resistor disclosed in Patent Literature 1 has a problem that the heat dissipation property or adhesive strength is likely to vary.

The present invention has been made in consideration of the above-described problem. Especially, it is an object of the present invention to provide a resistor manufacturing method, and a resistor for suppressing the thickness variation of the thermally conductive layer intervening between the resistive body and the electrode plates.

Solution to Problem

A resistor manufacturing method according to the present invention includes a step of forming an uncured first thermally conductive layer on a surface of a resistive body, a step of curing the first thermally conductive layer, a step of laminating an uncured second thermally conductive layer on a surface of the first thermally conductive layer, and a step of bending electrode plates respectively disposed at both sides of the resistive body, curing the second thermally conductive layer, and performing adhesion between the resistive body and the electrode plates via the first thermally conductive layer and the second thermally conductive layer.

A resistor according to the present invention includes a resistive body, electrode plates which are respectively disposed at both sides of the resistive body, and bent toward a lower surface side of the resistive body, and a plurality of cured thermally conductive layers intervening between the resistive body and the electrode plates.

Advantageous Effect of Invention

Unlike the generally employed method, a resistor manufacturing method according to the present invention ensures that the thickness variation of a thermally conductive layer between a resistive body and electrode plates is suppressed. The method allows manufacturing of a resistor while suppressing variation in the heat dissipation property and the adhesive strength.

DESCRIPTION OF EMBODIMENT

Figure 1A:
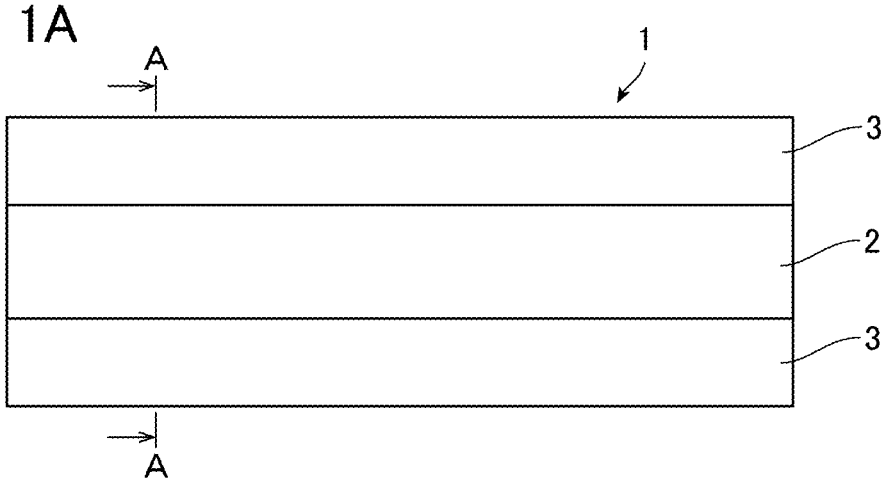
FIG. 1A is a plan view showing a manufacturing step of a resistor of an embodiment.

An embodiment according to the present invention (hereinafter simply referred to as an "embodiment") will be described in detail. The present invention is not limited to the following embodiment, but may be implemented in various modifications within a scope of the present invention.

(Resistor Manufacturing Method)

Referring to the drawings, a resistor manufacturing method of the embodiment will be described in the order of the manufacturing steps.

Figure 1B:
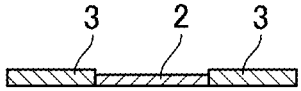
FIG. 1B is a sectional view taken along line A-A of FIG. 1A as seen from an arrow direction.

In steps as shown in FIGS. 1A and 1B, a resistive body 2 and a plurality of electrode plates 3 are prepared. Each of the resistive body 2 and the electrode plates 3 has a flat plate shape or a belt-like shape. In the embodiment as shown in FIG. 1A, each of the resistive body 2 and the electrode plates 3 has the belt-like shape.

In the step as shown in FIGS. 1A and 1B, the electrode plates 3 are bonded to both sides of the resistive body 2, respectively through laser welding, for example, to produce a bonded body 1. Besides the laser welding as an exemplified case, the existing bonding process may be executed. As FIG. 1A shows, the bonded body 1 may be constituted by bonding the resistive body 2 and the electrode plates 3 into the belt-like shape. The above-described bonded body 1 is wound in a roll, and placed on a production line. This makes it possible to execute the subsequent manufacturing steps automatically for mass-production of the resistors according to the embodiment.

In the embodiment, each thickness of the resistive body 2 and the electrode plate 3 is not limited. For example, the resistive body 2 may be formed to have the thickness ranging from several tens of μm to several hundreds of μm approximately. The resistive body 2 may be formed to have substantially the same thickness as, or different thickness from that of the electrode plate 3.

In the embodiment, existing material may be used for forming the resistive body 2 and the electrode plate 3 in a non-restrictive manner. For example, it is possible to use metal resistance material such as copper-nickel and nickel-chrome, a structure formed by applying a metal film onto the surface of an insulating base, a conductive ceramic substrate and the like for forming the resistive body 2. For example, it is possible to use copper, silver, nickel, chrome, and composite material thereof for forming the electrode plate 3.

When bonding the electrode plates 3 to both sides of the resistive body 2, respectively, each end surface of the resistive body 2 may be brought into abutment on the corresponding end surface of the electrode plates 3 as shown in FIG. 1B. Alternatively, the resistive body 2 and the electrode plates 3 may be bonded while having the respective surfaces partially overlapped with each another.

The resistive body 2 and the electrode plates 3 may be integrally formed. That is, it is possible to use the single metal resistance plate as the same material for forming the resistive body 2 and the electrode plates 3. Alternatively, plating of the metal material with low resistance is applied to the region to be formed as the electrode plate 3 on the metal resistance plate so that the electrode plate 3 is formed on the surface of the metal resistance plate.

Figure 2A:
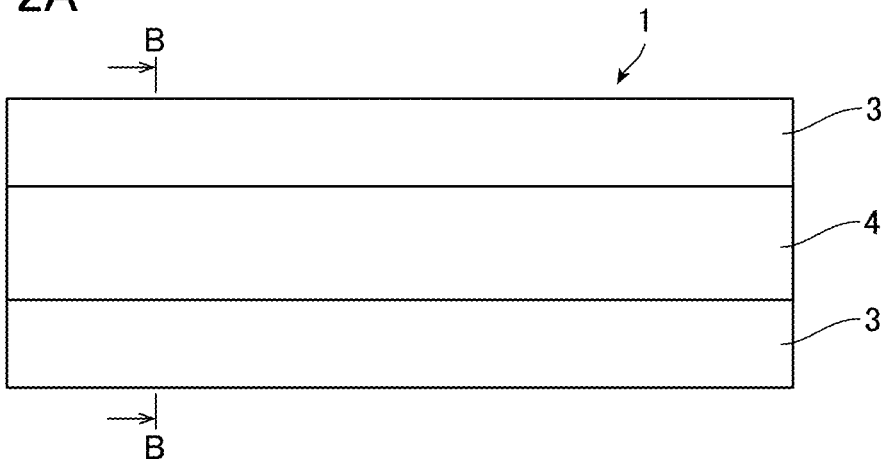
FIG. 2A is a plan view showing a manufacturing step subsequent to the step as shown in FIG. 1A.
Figure 2B:
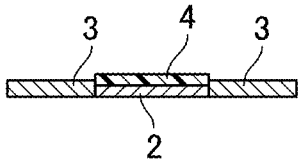
FIG. 2B is a sectional view taken along line B-B of FIG. 2A as seen from an arrow direction.

In the steps as shown in FIGS. 2A and 2B, an uncured first thermally conductive layer 4 is formed on the surface of the resistive body 2. Preferably, the first thermally conductive layer 4 is an electrically insulating thermosetting resin with high thermal conductivity. For example, the thermosetting resin such as epoxy and polyimide may be used for forming the first thermally conductive layer 4.

The uncured first thermally conductive layer 4 may be in the form of a film or a paste. In the case of the film, the uncured thermally conductive resin film is stuck on the surface of the resistive body 2. In the case of the paste, the uncured thermally conductive resin paste is applied to or printed on the surface of the resistive body 2. Alternatively, the first thermally conductive layer 4 may be formed by executing the inkjet process.

In the embodiment, the thickness of the first thermally conductive layer 4 is not limited. The thickness may be arbitrarily specified in consideration of the thermal conductivity of the resistor as the finished product, and secure fixation between the resistive body and the electrode plates. Especially, in the embodiment, there are two or more thermally conductive layers to be interposed between the resistive body and the electrode plates. It is therefore preferable to adjust the thickness of the first thermally conductive layer 4 in consideration of the number of layers. For example, preferably, the thickness of the first thermally conductive layer 4 is in the range from approximately 20 μm to 200 μm.

The term "uncured" refers to the state where the layer is not cured completely. Specifically, the uncured state where the layer has not been completely cured represents that curing reaction hardly proceeds to exhibit fluidity at the same level as that in the initial formation stage, or the state of the purchased product for shipment. The term "cured (completely cured)" refers to the state where the layer has lost the fluidity owing to accelerated polymerization due to linkage of molecules. For example, when the first thermally conductive layer 4 is formed as the thermally conductive resin film, the pre-processing (temporary crimping) is executed after placing the first thermally conductive layer 4 on the resistive body 2 as shown in FIG. 2B. The state after executing the pre-processing is defined as being the "uncured" state. That is, in the pre-processing, heat is applied (equal to or lower than the application temperature) for a short time (for example, approximately several minutes) to adhere (temporary crimping) the first thermally conductive layer 4 to the resistive body 2. The state after heating in the pre-processing is still in the "uncured" state.

When using the thermally conductive resin film for the first thermally conductive layer 4, the first thermally conductive layer 4 is in the uncured and solidified state. The term "solidified" refers to the state of having become solid.

Meanwhile, when using the thermally conductive resin paste for the first thermally conductive layer 4, the first thermally conductive layer 4 is in the uncured and unsolidified state. The term "unsolidified" refers to the state where the solid component is partially or entirely dispersed in the solvent such as slurry and ink.

Figure 2C:
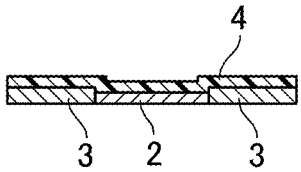
FIG. 2C is a sectional view of the structure that is different from the one as shown in FIG. 2B.

In the embodiment, the first thermally conductive layer 4 may be formed only on the surface of the resistive body 2 as shown in FIG. 2B. However, it is possible to form the first thermally conductive layer 4 on the entire surface from the resistive body 2 to the electrode plates 3 as shown in FIG. 2C. Alternatively, although not shown, it is possible to form the first thermally conductive layer 4 on the surface from the resistive body 2 to a part of each of the electrode plates 3. Alternatively, in the manufacturing step to be described below in which the electrode plates 3 are bent, it is possible to form the first thermally conductive layer 4 on the region except the bent parts. That is, the first thermally conductive layer 4 may be formed in three divided parts on the respective surfaces of the resistive body 2 and the electrode plates 3 except the boundary therebetween.

As FIG. 2C shows, the first thermally conductive layer 4 is formed not only on the surface of the resistive body 2 but also on the surfaces of the electrode plates 3. This makes it possible to facilitate formation of the first thermally conductive layer 4. When using the thermally conductive resin film for the first thermally conductive layer 4, for example, as FIG. 2C shows, the thermally conductive resin film does not have to be positioned to the resistive body 2. The thermally conductive resin film that is large enough to cover the resistive body 2 and the electrode plates 3 may be stuck on the surfaces of the resistive body 2 and the electrode plates 3. Alternatively, when using the thermally conductive resin paste for the first thermally conductive layer 4, the first thermally conductive layer 4 may be applied to the surfaces of the resistive body 2 and the electrode plates 3 entirely. As described above, the manufacturing step may be simplified by forming the first thermally conductive layer 4 not only on the surface of the resistive body 2 but also on the surfaces of the electrode plates 3.

Then the heating process is applied to the uncured first thermally conductive layer 4 for complete curing. At this time, the use of the thermally conductive resin paste for the first thermally conductive layer 4 may facilitate solidification and curing. The determination whether or not the layer has been completely cured may be made in accordance with the cure degree, viscosity, thermal processing condition and the like. It is possible to use the cure degree to be calculated from the calorific value derived from the measurement utilizing the differential scanning calorimeter. Complete curing refers to the condition where the cure degree is equal to or higher than 70%, or refers to the condition generally called stage C.

As the uncured first thermally conductive layer 4 is cured, the thermally conductive layer having the film thickness hardly fluctuating is securely formed on the surface of the resistive body 2, or on the surfaces of the resistive body 2 and the electrode plates 3 before the electrode plates 3 are bent in the subsequent step.

Although it is not intended to limit the thermal processing condition for completely curing the first thermally conductive layer 4, it is preferable to apply the heating process to the first thermally conductive layer 4 at the temperature ranging from approximately 150° C. to 250° C. for approximately 0.5 to 2 hours. The heating temperature and the heating time required for curing may vary depending on the material for forming the first thermally conductive layer 4. If the first thermally conductive layer 4 is the purchased product, the curing condition is specified in accordance with the heating temperature and the heating time as prescribed by the manufacturer. For example, the heating temperature and the heating time of the resin used for the experiment to be described later are specified to be in the range from approximately 160° C. to 200° C., and approximately 70 to 30 minutes (the lower the heating temperature becomes, the longer the heating time is set) for appropriate adjustment.

Figure 3A:
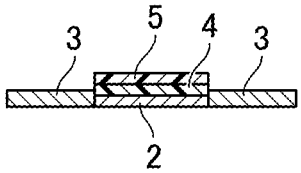
FIG. 3A is a sectional view showing a manufacturing step subsequent to the step as shown in FIG. 2A.
Figure 3B:
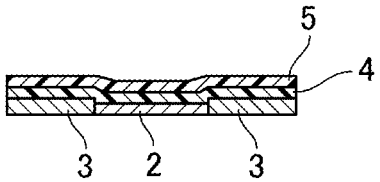
FIG. 3B is a sectional view showing a manufacturing step subsequent to the step as shown in FIG. 2B.

In the embodiment, subsequent to the step as shown in FIG. 2B, an uncured second thermally conductive layer 5 is laminated on the surface of the first thermally conductive layer 4 as shown in FIG. 3A. Alternatively, subsequent to the step as shown in FIG. 2C, the uncured second thermally conductive layer 5 is laminated on the surface of the first thermally conductive layer 4 as shown in FIG. 3B.

In the embodiment, it is possible to use either the same or different material for forming the first thermally conductive layer 4 as or from the material for the second thermally conductive layer 5. It is also possible to use the thermally conductive resin film, or the thermally conductive resin paste for the second thermally conductive layer 5. Accordingly, the second thermally conductive layer 5 formed as the thermally conductive resin film is in the uncured and solidified state. Meanwhile, the second thermally conductive layer 5 formed as the thermally conductive resin paste is in the uncured and unsolidified state.

In an exemplified case, the thermally conductive resin film may be used for the first thermally conductive layer 4, and the thermally conductive resin film or the thermally conductive resin paste may be used for the second thermally conductive layer 5. For example, it is preferable to use the same thermally conductive resin film for both the first thermally conductive layer 4 and the second thermally conductive layer 5 for improving productivity of the resistor.

The total value of thicknesses of the first thermally conductive layer 4 and the second thermally conductive layer 5, which are laminated is appropriately adjusted so that the interval between the resistive body 2 and the electrode plates 3 is brought into a predetermined range after the electrode plates 3 are bent in the subsequent step.

When using the thermally conductive resin film for the second thermally conductive layer 5, the pre-processing is executed as described above so that the second thermally conductive layer 5 is fixed to the first thermally conductive layer 4.

Figure 4A:
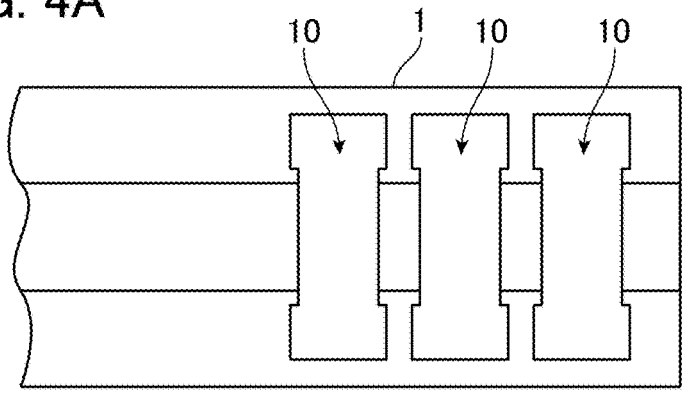
FIG. 4A is a plan view showing a manufacturing step subsequent to the steps as shown in FIGS. 3A and 3B.
Figure 4B:
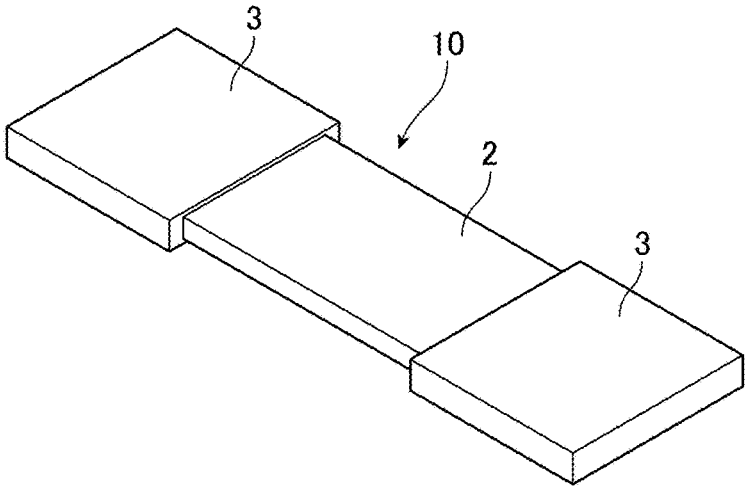
FIG. 4B is a perspective view of a resistor intermediate cut in the step as shown in FIG. 4A.

As FIG. 4A shows, a resistor intermediate 10 is cut from the bonded body 1 constituted by the completely cured first thermally conductive layer 4 and the uncured second thermally conductive layer 5. FIG. 4B is a perspective view of the cut resistor intermediate 10.

As the belt-like bonded body 1 as shown in FIG. 4A is longitudinally fed, the plurality of resistor intermediates 10 may be continuously cut by a press machine along the longitudinal direction. This makes it possible to mass-produce the resistor intermediates 10 in a short period of time.

The resistor intermediate 10 is constituted by the resistive body 2 having a rectangular outer shape, and the electrode plates 3 each having a rectangular outer shape provided at the respective sides of the resistive body 2. The outer shape of the resistor intermediate 10 as shown in FIG. 4B is a mere example. It is therefore possible to form the resistor intermediate 10 to have the outer shape other than the one as shown in FIG. 4B.

Figure 5:
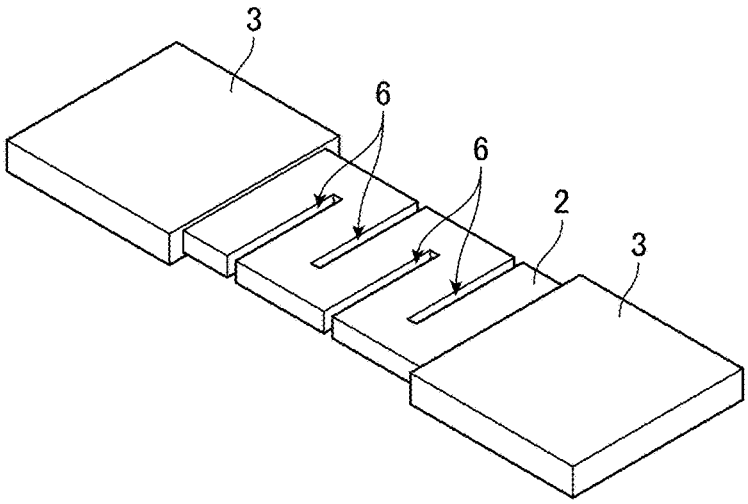
FIG. 5 is a perspective view showing a manufacturing step subsequent to the step as shown in FIG. 4B.

As FIG. 5 shows, a plurality of cut portions 6 are formed in the resistive body 2 so that a meander pattern is formed for adjusting the resistance. Each length, each position, and the number of the cut portions 6 may be appropriately adjusted so that the resistive body 2 has a predetermined resistance value. The step as shown in FIG. 5 may be executed as needed.

Figure 6A:
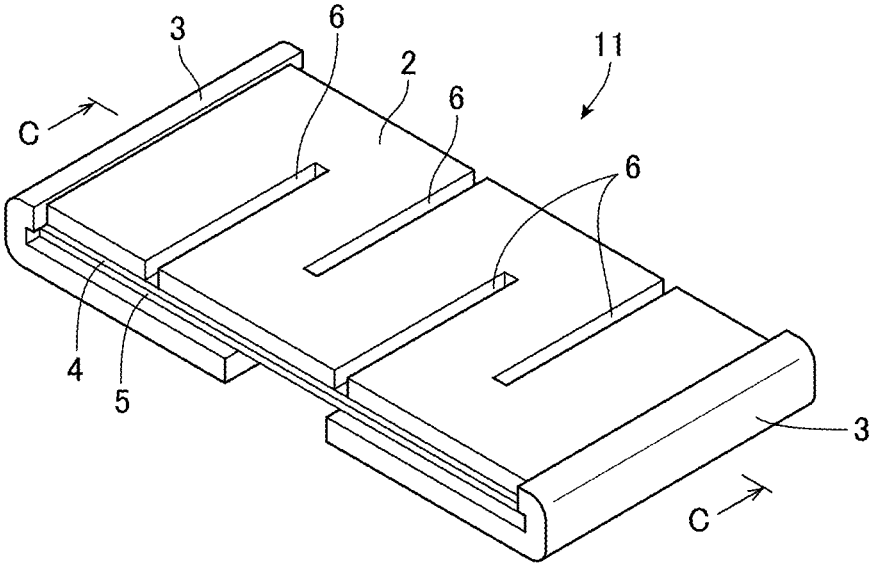
FIG. 6A is a perspective view showing a manufacturing step subsequent to the step as shown in FIG. 5.
Figure 6B:
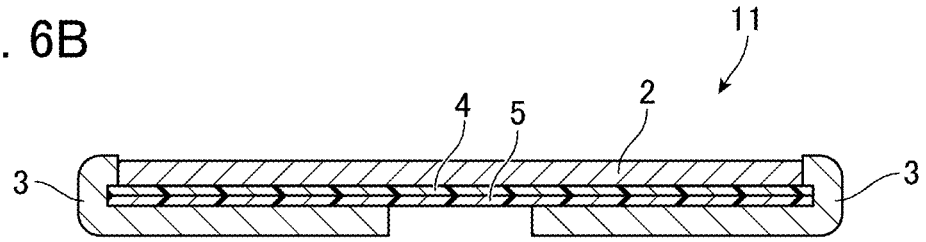
FIG. 6B is a sectional view taken along line C-C of FIG. 6A in a thickness direction as seen from an arrow direction.
Figure 6C:
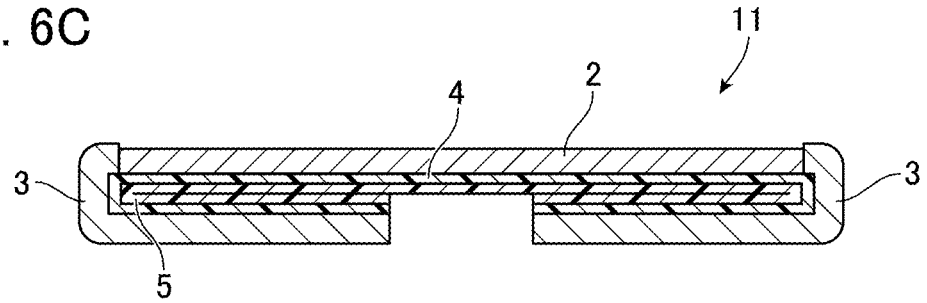
FIG. 6C is a sectional view of a structure that has been formed using the resistor intermediate as shown in FIG. 3B.

As FIG. 6A shows, the electrode plates 3 are bent to the side of the resistive body 2, on which the first thermally conductive layer 4 and the second thermally conductive layer 5 are laminated, respectively. Referring to FIG. 6A, as the first thermally conductive layer 4 and the second thermally conductive layer 5 are formed on the lower surface side of the resistive body 2, the electrode plates 3 are bent toward the lower side. Each of FIGS. 6B and 6C shows a cross section of the resistor 11 while omitting the cut portions 6 in the resistive body 2, which are expected to appear in FIGS. 6B and 6C. Each dimension ratio of the thickness and the length of the resistive body 2, the electrode plates 3 and the thermally conductive layer 4 is different between the cases as shown in FIGS. 3A and 3B, and the cases as shown in FIGS. 6B and 6C. The dimension ratio of the thickness and the length of the resistive body 2, the electrode plates 3, and the thermally conductive layer 4 as illustrated in FIGS. 3A and 3B is different from that as illustrated in FIGS. 6B and 6C. However, structures which are enlarged for illustration purposes are substantially the same from a physical viewpoint.

As FIGS. 6A and 6B show, the bent electrode plates 3 confront the lower side of the resistive body 2 via the first thermally conductive layer 4 and the second thermally conductive layer 5. Likewise the case as shown in FIG. 3A, FIG. 6B shows the structure constituted by using the resistor intermediate formed by laminating the first thermally conductive layer 4 and the second thermally conductive layer 5 on the surface of the resistive body 2, and bending the electrode plates 3. Accordingly, the single first thermally conductive layer 4 and the single second thermally conductive layer 5 intervene between the resistive body 2 and the bent electrode plates 3.

Meanwhile, likewise the structure as shown in FIG. 3B, FIG. 6C shows the structure constituted by using the resistor intermediate formed by laminating the first thermally conductive layer 4 and the second thermally conductive layer 5 over the surfaces from the resistive body 2 to the electrode plates 3 entirely, and bending the electrode plates 3. Accordingly, the double-layered first thermally conductive layer 4 and the double-layered second thermally conductive layer 5 intervene between the resistive body 2 and the bent electrode plates 3. Referring to FIG. 6C, the single layer of the first thermally conductive layer 4 and the single layer of the second thermally conductive layer 5 are laminated at the center part of the resistive body 2 to which the electrode plates 3 do not confront.

The second thermally conductive layer 5 in the uncured state is heated to be completely cured. The term "complete curing" refers to the explanation that has been already described as above.

In the embodiment, it is preferable to completely cure the second thermally conductive layer 5 while pressing the bent electrode plates 3 toward the resistive body 2. That is, as FIG. 6B shows, the bent electrode plates 3 are pressed while being in contact with the second thermally conductive layer 5, and heated so that the second thermally conductive layer 5 is completely cured. As FIG. 6C shows, the first thermally conductive layer 4 and the second thermally conductive layer 5 at the inner sides of the bent electrode plates 3 are pressed while being laminated with the first thermally conductive layer 4 and the second thermally conductive layer 5 on the lower surface of the resistive body 2, and heated so that the second thermally conductive layers 5 are completely cured. This makes it possible to securely adhere and fix the resistive body 2 and the electrode plates 3 via the first thermally conductive layers 4 and the second thermally conductive layers 5.

Figure 7A:
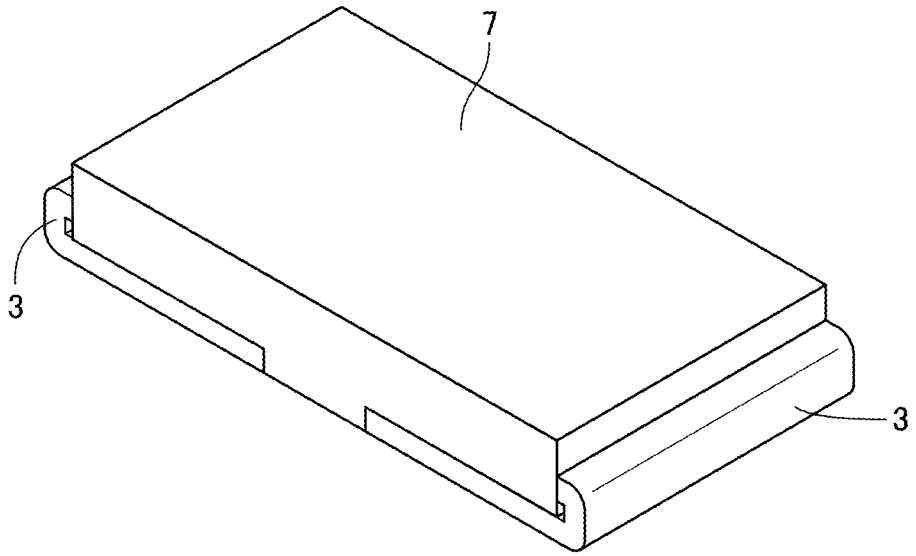
FIG. 7A is a perspective view showing a manufacturing step subsequent to the step as shown in FIG. 6A.
Figure 7B:
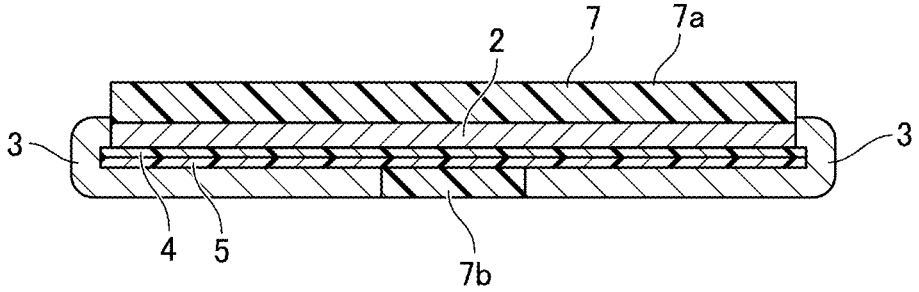
FIG. 7B is a sectional view showing a manufacturing step subsequent to the step as shown in FIG. 6B.
Figure 7C:
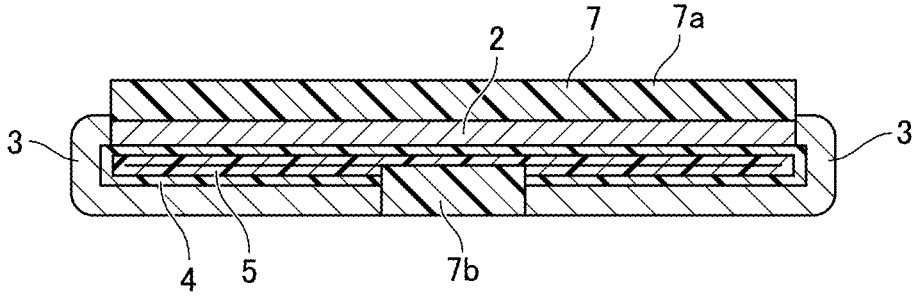
FIG. 7C is a sectional view showing a manufacturing step subsequent to the step as shown in FIG. 6C.

Then in the step as shown in FIG. 7A, a protective layer 7 is mold-formed onto the surface of the resistive body 2. Preferably, the protective layer 7 is formed of a material with excellent heat resisting and electrically insulating properties. Although it is not intended to limit the material for forming the protective layer 7, the mold-forming of the protective layer 7 may be executed using the resin, glass, organic material and the like. As FIGS. 7B and 7C show, the protective layer 7 includes a surface protective layer 7*a* for covering the surface of the resistive body 2, and a bottom surface protective layer 7*b* for filling the space between the bent electrode plates 3 at the lower surface side of the resistive body 2. As FIGS. 7B and 7C show, the bottom surface protective layer 7*b* and the electrode plates 3 constitute substantially the flush bottom surface. FIG. 7B shows the step subsequent to the one as shown in FIG. 6B, and FIG. 7C shows the step subsequent to the one as shown in FIG. 6C.

It is possible to affix a seal on the surface of the surface protective layer.

Figure 8A:
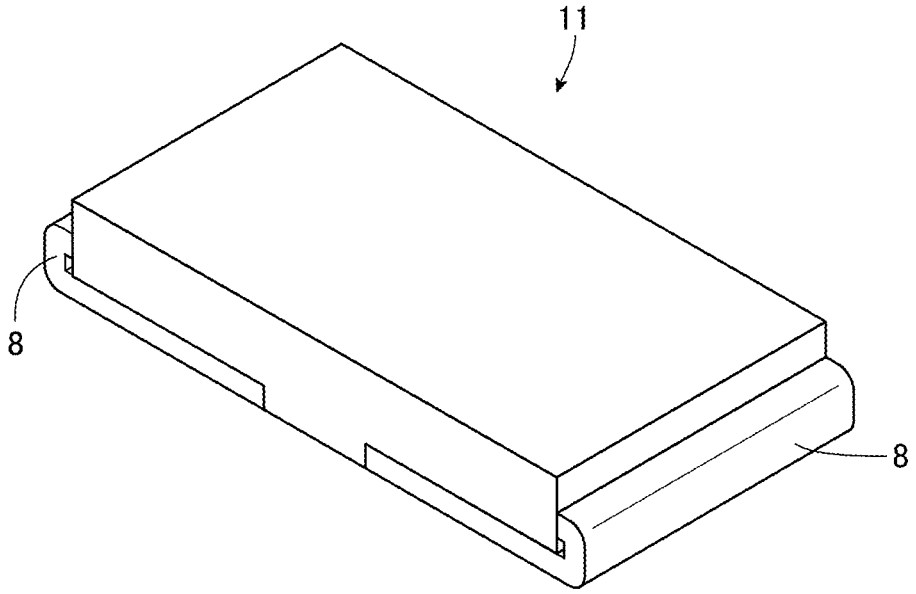
FIG. 8A is a perspective view showing a manufacturing step subsequent to the step as shown in FIG. 7A.
Figure 8B:
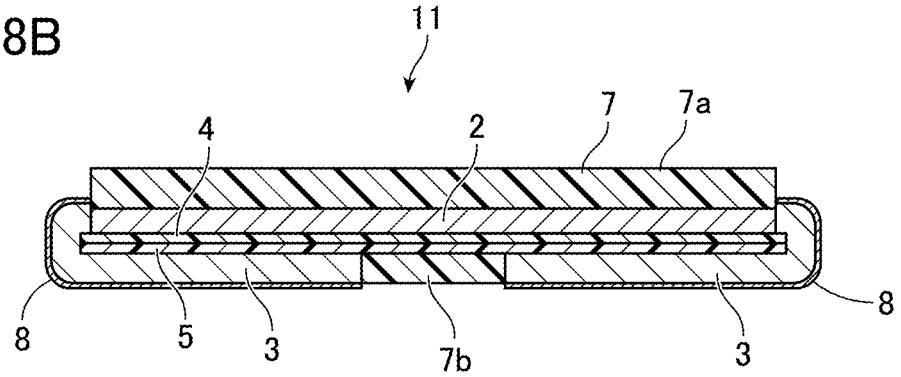
FIG. 8B is a sectional view showing a manufacturing step subsequent to the step as shown in FIG. 7B.
Figure 8C:
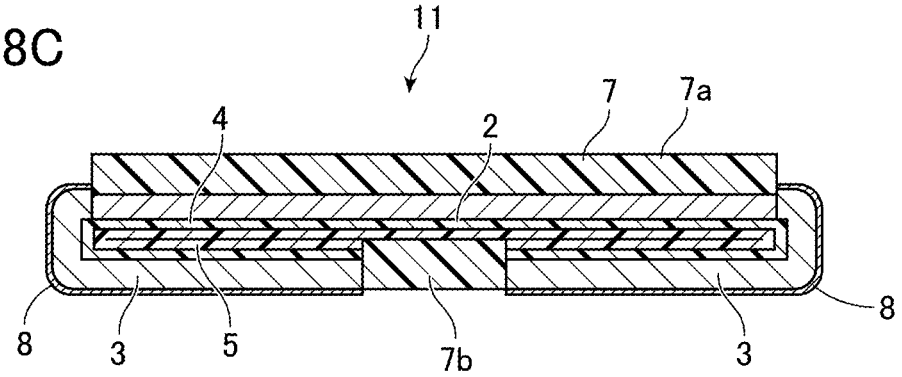
FIG. 8C is a sectional view showing a manufacturing step subsequent to the step as shown in FIG. 7C.

As FIGS. 8A, 8B, and 8C show, plating is applied to surfaces of the electrode plates 3. Although the material for forming a plating layer 8 is not limited, the plating layer 8 may be constituted by a Cu plating layer and an Ni plating layer, for example. The plating layer 8 serves to expand the contact area to the substrate surface on which the resistor 11 is disposed, and suppress the soldering erosion of the electrode plate 3 upon soldering of the resistor 11 to the substrate surface. FIG. 8B represents the step subsequent to the one as shown in FIG. 7B. FIG. 8C represents the step subsequent to the one as shown in FIG. 7C. The plating process is carried out as needed.

(Resistor)

The resistor 11 manufactured through the above-described manufacturing steps includes the resistive body 2, the electrode plates 3 disposed at both sides of the resistive body 2, respectively while being bent at the lower surface side of the resistive body 2, and the plurality of cured thermally conductive layers 4, 5 intervening between the resistive body 2 and the electrode plates 3 as shown in FIGS. 8B and 8C.

A total value of thicknesses of the plurality of thermally conductive layers 4 and 5 that intervene between the resistive body 2 and the electrode plates 3 ranges from approximately 50 μm to 150 μm. Each thickness of the thermally conductive layers 4, 5 is adjusted to have the total thickness thereof within the above-described range so that heat dissipation property from the resistive body 2 to the electrode plates 3 via the thermally conductive layers 4, 5 may be appropriately improved. That is, compared with the case where the thermally conductive layer is constituted by the single layer, the thermally conductive layers 4, 5 of the embodiment allow the thickness between the resistive body 2 and the electrode plates 3 to be made more uniform, and variation in the heat dissipation property may also be suppressed. This makes it possible to provide the resistor 11 with improved heat dissipation property. The total value of thicknesses of the thermally conductive layers 4, 5 is adjusted to be within the above-described range to allow improvement in tight contactness between the resistive body 2 and the electrode plates 3. This makes it possible to appropriately prevent the failure such as peeling of the electrode plate 3 from the thermally conductive layer, or crack generated in the thermally conductive layer.

The resistor manufacturing method of the embodiment is characterized in that, after completely curing the first thermally conductive layer 4, the uncured second thermally conductive layer 5 is laminated on the first thermally conductive layer, and thereafter, the electrode plates 3 are bent, and the second thermally conductive layer 5 is cured.

Execution of the above-described manufacturing steps allows suppression of variation in each thickness of the thermally conductive layers 4, 5 between the resistive body 2 and the electrode plates 3 compared with the generally employed steps. That is, upon execution of the heating process after bending of the electrode plates 3, the first thermally conductive layer 4 of those thermally conductive layers has been already cured, thus hardly causing the film thickness fluctuation. At this time, the second thermally conductive layer 5 has been uncured. However, the second thermally conductive layer 5 partially constitutes the thickness between the resistive body 2 and the electrode plates 3. The variation in the thickness of the thermally conductive layer resulting from fluidity of the second thermally conductive layer 5 may be made smaller than the case where the entire thermally conductive layer between the resistive body 2 and the electrode plates 3 is in the uncured state.

As described above, in the embodiment, it is possible to suppress variation in the thickness of the thermally conductive layer between the resistive body 2 and the electrode plates 3. This makes it possible to make the thickness between the resistive body 2 and the electrode plates 3 further uniform, and to suppress variation in the heat dissipation property, thus manufacturing the resistor 11 with excellent heat dissipation property. The further uniform thickness between the resistive body 2 and the electrode plates 3 may suppress generation of a gap or the like between the resistive body 2 and the electrode plates 3, resulting in improved adhesive strength.

The uncured and solidified material, specifically, the thermally conductive resin film may be preferably used for forming at least any one of the first thermally conductive layer 4 and the second thermally conductive layer 5.

When using the uncured and unsolidified material, specifically, the thermally conductive resin paste for forming both the first thermally conductive layer 4 and the second thermally conductive layer 5, the thickness between the resistive body 2 and the electrode plates 3 is likely to vary. That is, intrinsically, the use of the thermally conductive resin paste is likely to vary the thickness in the state where the paste is applied. Consequently, the use of the thermally conductive resin film in the uncured and solidified state for forming at least one of the first thermally conductive layer 4 and the second thermally conductive layer 5 makes it possible to suppress the thickness variation between the resistive body 2 and the electrode plates 3 more effectively. The use of the thermally conductive resin film for forming both the first thermally conductive layer 4 and the second thermally conductive layer 5 allows adjustment of the thickness between the resistive body 2 and the electrode plates 3 so that the thickness is made further uniform.

For example, the thermally conductive resin film is used for forming the first thermally conductive layer 4 to adjust so that the thickness between the resistive body 2 and the electrode plates 3 is within a predetermined range. Meanwhile, the thermally conductive resin paste is thinly applied to form the second thermally conductive layer 5 to adhere the electrode plates 3. This makes it possible to easily adjust the thickness within the predetermined range while suppressing variation in the thickness between the resistive body 2 and the electrode plates 3, and to securely adhere the electrode plates 3.

In the steps as shown in FIGS. 6A, 6B, and 6C, it is preferable to cure the second thermally conductive layer 5 while pressing the bent electrode plates 3. This makes it possible to securely adhere the electrode plates 3.

Example

The present invention will be described in more detail based on an example implemented to exhibit the advantageous effect of the present invention. However, the present invention is not limited to the example as described below.

In an experiment, the following resin was used, and the thermal analysis was carried out using a differential scanning calorimeter (DSC).

[Resin]

Polyimide/Epoxy Resin

[Differential Scanning Calorimeter]

DSC8231 manufactured by Rigaku Corporation

The DSC curve and the DDSC curve were obtained at the temperature elevation rate of 10° C./min in the experiment.

Figure 9:
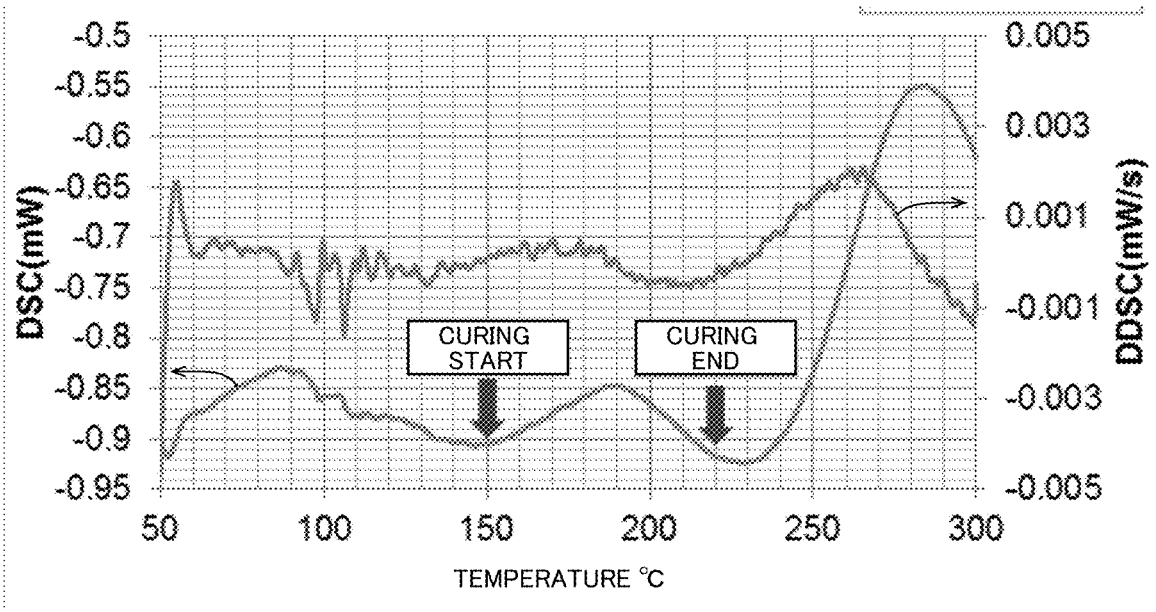
FIG. 9 is a graph showing a DSC curve and a DDSC curve of a polyimide/epoxy resin.

As FIG. 9 shows, the curing start temperature was 150° C., and the curing end temperature was 220° C. At the timing when the temperature becomes 230° C. onward, transition of the phase to the combustion reaction was observed.

In accordance with the experimental result, the applied temperature was measured to be in the range from 160° C. to 220° C.

The temperature was fixed to 170° C. to obtain the curing start temperature and the curing end temperature from the DSC curve in accordance with the holding time. The obtained experimental results are shown in FIG. 10.

Figure 10:
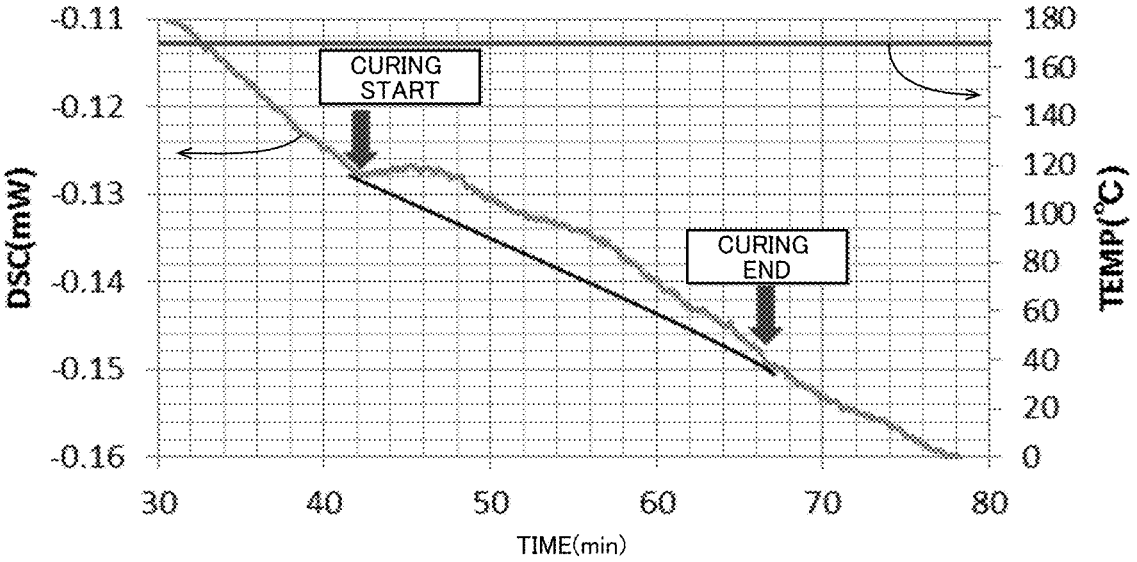
FIG. 10 is a graph showing the DSC curve of the polyimide/epoxy resin at a temperature fixed to 170° C.

FIG. 10 shows that the curing started after a lapse of about 42 minutes, and the curing ended after a lapse of about 61 minutes.

The above-described experimental result has clarified that the resin to be used as specified above was cured under the condition at 170° C. for approximately 60 minutes. The curing condition coincided with the curing condition recommended by the resin manufacturer.

As the curing condition is established at 170° C. for 60 minutes, the curing condition in the temperature range as shown in FIG. 9 may be established at 160° C. for 70 minutes, 170° C. for 60 minutes, 180° C. for 50 minutes, 190° C. for 40 minutes, and 200° C. for 30 minutes approximately.

INDUSTRIAL APPLICABILITY

The resistor according to the present invention with excellent heat dissipation property allows reduction in its height. The resistor may be surface mounted so as to be mounted to various types of circuit boards.

The present application claims priority from Japanese Patent Application No. JP2017-237820 filed on Dec. 12, 2017, the content of which is hereby incorporated by reference into this application.

The invention claimed is:

1. A resistor manufacturing method, comprising:

forming an uncured first thermally conductive layer on a surface of a resistive body;

curing the first thermally conductive layer;

laminating an uncured second thermally conductive layer on a surface of the first thermally conductive layer; and bending electrode plates respectively disposed at both sides of the resistive body, curing the second thermally conductive layer, and performing adhesion between the resistive body and the electrode plates via the first thermally conductive layer and the second thermally conductive layer.

2. The resistor manufacturing method according to claim 1, wherein at least any one of the first thermally conductive layer and the second thermally conductive layer is formed using a material in an uncured and solidified state.

3. The resistor manufacturing method according to claim 2, wherein at least any one of the first thermally conductive layer and the second thermally conductive layer is a thermally conductive resin film.

4. The resistor manufacturing method according to claim 1, wherein the second thermally conductive layer is cured while having a pressure applied to the electrode plates that have been bent.

* * * * *